US005200898A

United States Patent [19]

Yuhara et al.

[11] Patent Number: 5,200,898

[45] Date of Patent: Apr. 6, 1993

[54] METHOD OF CONTROLLING MOTOR VEHICLE

[75] Inventors: Hiromitsu Yuhara; Ryujin Watanabe, both of Wako, Japan

[73] Assignee: Honda Giken Kogyo Kabushiki Kaisha, Tokyo, Japan

[21] Appl. No.: 614,194

[22] Filed: Nov. 15, 1990

[30] Foreign Application Priority Data

Nov. 15, 1989 [JP] Japan ..... 1-296591

[51] Int. Cl.[5] ..... F02D 41/04

[52] U.S. Cl. ..... 364/431.05; 364/431.04; 395/905; 123/361; 123/480

[58] Field of Search ..... 364/431.04, 431.05, 364/431.06; 123/361, 399, 478, 480, 492, 493; 395/21, 905

[56] References Cited

U.S. PATENT DOCUMENTS

| | | | |
|---|---|---|---|
| 4,735,181 | 4/1988 | Kaneko et al. | 123/361 |
| 4,868,755 | 9/1989 | McNulty et al. | 364/424.01 |
| 4,896,639 | 1/1990 | Holmes | 364/431.08 |
| 5,041,976 | 8/1991 | Marko et al. | 364/431.04 |
| 5,083,480 | 1/1992 | Abo et al. | 364/424.1 |

OTHER PUBLICATIONS

"Using Neural Nets: Representing Knowledge" Part I, by Maureen Caudill, AI Expert, Dec. 1989, pp. 34–41.

"Learning to Control an Inverted Pendulum Using Neural Networks" by C. W. Anderson, *IEEE Control System Magazine*, Apr. 1989, pp. 31–37.

*Primary Examiner*—Vincent N. Trans

*Attorney, Agent, or Firm*—Lyon & Lyon

[57] ABSTRACT

A motor vehicle is controlled with a neural network which has a data learning capability. A present value of the throttle valve opening of the engine on the motor vehicle and a rate of change of the present value of the throttle valve opening are periodically supplied to the neural network. The neural network is controlled to learn the present value of the throttle valve opening when the rate of change of the present value of the throttle valve opening becomes zero so that a predicted value of the throttle valve opening approaches the actual value of the throttle valve opening at the time the rate of change thereof becomes zero. An operating condition of the motor vehicle is controlled based on the predicted value of the throttle valve opening, which is represented by a periodically produced output signal from the neural network.

10 Claims, 6 Drawing Sheets

SUBROUTINE FOR PREDICTING THROTTLE VALVE OPENING

METHOD OF CONTROLLING MOTOR VEHICLE

BACKGROUND OF THE INVENTION

1. Field of the Invention

The present invention relates to a method of controlling a condition in which a motor vehicle operates, e.g., the rate at which fuel is supplied to the engine on the motor vehicle, or the time at which the automatic transmission on the motor vehicle is actuated for a speed change, depending on parameters such as the opening of the throttle valve of the engine.

2. Prior Art

Modern motor vehicles incorporate automatic control systems which employ microcomputers or the like to control vehicle operating conditions depending on parameters such as the opening of the throttle valve of engines mounted on the motor vehicles. For example, one automatic motor vehicle control system controls the speed-changing operation of an automatic transmission according to a predetermined shift schedule map based on the vehicle speed and the throttle valve opening.

In the conventional automatic control system, the present value of the throttle valve opening and other present values are used as parameters for controlling the vehicle operating conditions. When the automatic transmission is controlled by the above automatic control system, therefore, the following problems arise upon a kickdown:

(1) After the throttle valve is opened, there is a certain time lag before a downshift is achieved.

(2) Since the transmission is shifted into a lower gear after the throttle valve has been opened and the rotational speed of the engine has increased, a large shock is produced by the gear shift.

(3) If the rotational speed of the engine were prevented from increasing until the downshift is finished in order to solve the problem (2) above, no large shock would be produced, but the time lag would be increased before the downshift is completed.

To solve the above problems at the same time, it would be desirable to predict how far the throttle valve will be opened when the throttle valve starts being opened and to control an automatic transmission depending on the predicted throttle valve opening. In this manner, a downshift would be completed quickly without a large shock being produced by such a downshift.

The rate at which fuel is supplied to an engine on a motor vehicle would also be controlled with a high response, using the above predicted control process.

However, since the throttle valve is opened in various different ways depending on the driver, road conditions, and other factors, it would be difficult to predict how far the throttle valve will be opened under every possible condition according to a fixed algorithm.

SUMMARY OF THE INVENTION

In view of the aforesaid drawbacks of the conventional motor vehicle control processes, it is an object of the present invention to provide a method of controlling a motor vehicle by predicting how far a throttle valve will be opened when the throttle valve starts being opened, and controlling a vehicle operating condition based on the predicted throttle valve opening.

According to the present invention, there is provided a method of controlling a motor vehicle having an engine, with a neural network which has a learning capability, comprising the steps of periodically supplying the present value of the throttle valve opening of the engine and the rate of change of the present value of the throttle valve opening to the neural network, controlling the neural network to learn the present value of the throttle valve opening when the rate of change of the present value of the throttle valve opening becomes zero so that a predicted value of the throttle valve opening approaches the actual value of the throttle valve opening at the time the rate of change thereof becomes zero, and controlling an operating condition of the motor vehicle based on the predicted value of the throttle valve opening, which is represented by a periodically produced output signal from the neural network.

Each time a series of throttle valve opening changes or a stroke of throttle valve opening is finished while the motor vehicle is running, the neural network is controlled to learn a maximum value of the range of change of the throttle valve opening. It is thus possible for the neural network to predict, taking into account habitual actions of the driver of the motor vehicle, how far the throttle valve will be opened, at the time the throttle valve starts being opened.

When the rate of change of the actual throttle valve opening value is minimized before the rate of change become zero, the neural network is controlled to learn the present value of the throttle valve opening so that the predicted value of the throttle valve opening approaches the actual value of the throttle valve opening at the time when the rate of change is minimized. Therefore, the accuracy of the predicted value of the throttle valve opening is prevented from being lowered at that time.

Furthermore, the predicted value of the throttle valve opening is corrected, and the operating condition of the motor vehicle is controlled based on the predicted value after it has been corrected. This correcting process is also effective in preventing the predicted throttle valve opening value from becoming an undesirable value.

The above and other objects, features and advantages of the present invention will become more apparent from the following description when taken in conjunction with the accompanying drawings in which a preferred embodiment of the present invention is shown by way of illustrative example.

DETAILED DESCRIPTION OF THE PREFERRED EMBODIMENT

Figure 1:
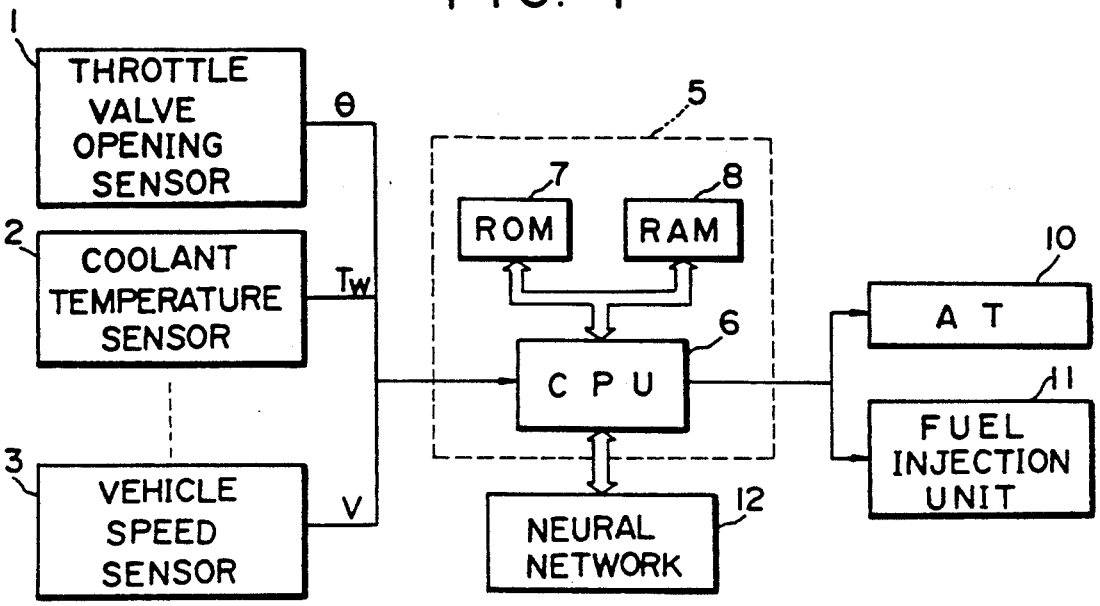
FIG. 1 is a block diagram of a control system for carrying out a motor vehicle control method according to the present invention.

As shown in FIG. 1, a control system for carrying out a motor vehicle control method according to the present invention includes various sensors such as a throttle valve opening sensor 1 for detecting a throttle valve opening $\theta$ of an engine mounted on a motor vehicle (not shown), a coolant temperature sensor 2 for detecting the temperature $T_w$ of the coolant of the engine, and a vehicle speed sensor 3 for detecting the speed V of travel of the motor vehicle. Output signals from these sensors are applied to a CPU 6 of a central control unit 5 through an A/D converter and a multiplexer (not shown). The central control unit 5 includes a ROM 7 and a RAM 8 in addition to the CPU 6. The CPU 6 stores the output signals from the sensors into the RAM 8 and effects various arithmetic operations using the stored output signals. Based on the results of the arithmetic operations, the CPU 6 applies suitable control command signals to an automatic transmission (AT) 10 on the motor vehicle and a fuel injection unit 11 for supplying fuel to the engine. A neural network (NN) 12 is connected to or included in the CPU 6, for predicting a throttle valve opening as described later on.

Figure 2:
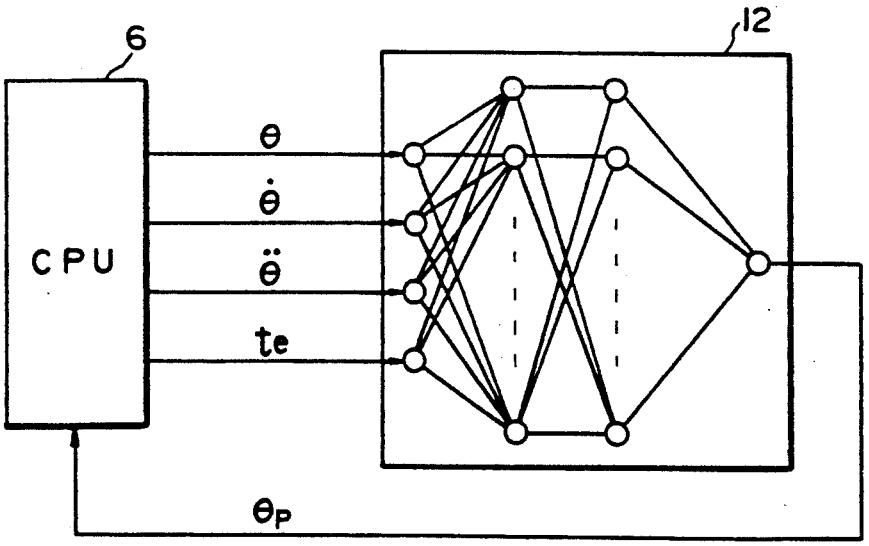
FIG. 2 is a block diagram of a neural network employed in the control system shown in FIG. 1.

As shown in FIG. 2, the neural network 12 is of a four-layer construction comprising an input layer composed of four neurons, first and second intermediate layers each composed of eight neurons, and an output layer composed of one neuron. While the neural network 12 may be of a three-layer construction with one of the intermediate layers omitted, the illustrated neural network 12 includes four layers because a four-layer construction is necessary to predict a throttle valve opening under various motor vehicle operating conditions. Each of the first and second intermediate layers comprises eight neurons since, if it were composed of too many neurons, the number of calculations to be carried out would be increased.

The neurons of the input layer are supplied, respectively, with a signal indicative of the throttle valve opening $\theta$, a signal indicative of a rate $\theta$ of change of the throttle valve opening (i.e., throttle valve opening speed), a signal indicative of a rate $\theta$ of change of the throttle valve opening speed (i.e., throttle valve opening acceleration), and a time $t_e$ for which the throttle or accelerator pedal is depressed, from the CPU 6. In response to these supplied signals, the output layer of the neural network 12 applies, to the CPU 6, an output signal representing a predicted value $\theta_p$ for a future throttle valve opening, which is predicted by the neural network 12 based on the signals supplied to the input layer.

Figure 3:
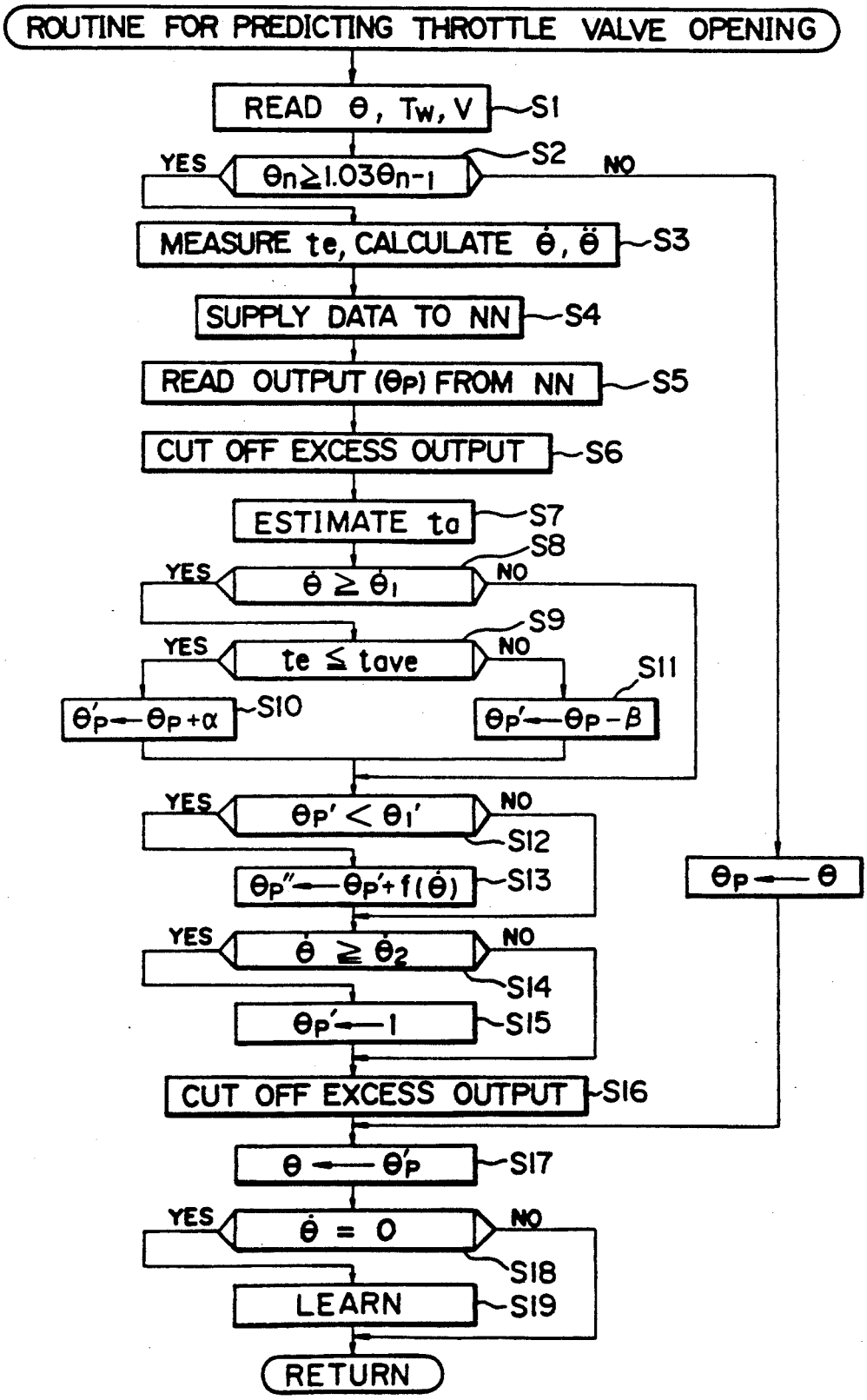
FIG. 3 is a flowchart of an operation sequence of the control system shown in FIG. 1.

FIG. 3 shows, by way of example, a subroutine which is carried out by the CPU 6.

The subroutine shown in FIG. 3 enables the CPU 6 to cause the neural network 12 to predict a future throttle valve opening and also enables the CPU 6 to control the operating condition of the motor vehicle based on the predicted throttle opening value. The subroutine is carried out every 10 msec., for example.

When the subroutine starts being carried out, the CPU 6 reads the present throttle valve opening $\theta$, the present coolant temperature $T_w$, and the present vehicle speed V, as present data, in a step S1.

Then, the CPU 6 compares the present throttle valve opening $\theta_n$ with the previously read throttle valve opening $\theta_{n-1}$ as multiplied by 1.03 in a step S2. If the present throttle valve opening $\theta_n$ is greater than the previous throttle valve opening $\theta_{n-1}$ as multiplied by 1.03, then it is necessary to predict how far the throttle valve will be opened since it is considered that the throttle valve is being opened.

The CPU 6 measures a depression time $t_e$ for which the accelerator pedal is depressed, the time $t_e$ being necessary to predict the final throttle valve opening $\theta$, and calculates a throttle valve opening speed $\theta$ and a throttle valve opening acceleration $\theta$ in a step S3. The depression time $t_e$ is the time which has elapsed after the driver starts depressing the accelerator pedal. The throttle valve opening speed $\theta$ is the rate of change of the throttle valve opening $\theta$, i.e., a value produced when the throttle valve opening $\theta$ is differentiated once with respect to the time, and the throttle valve opening acceleration $\theta$ is the rate of change of the throttle valve opening speed $\theta$, i.e., a value produced when the throttle valve opening $\theta$ is differentiated twice with respect to the time. Then, the CPU 6 supplies the throttle valve opening $\theta$, the throttle valve opening speed $\theta$, the throttle valve opening acceleration $\theta$, and the depression time $t_e$ to the neural network 12 in a step S4. The values supplied to the neural network 12 are adjusted such that they are dispersed in the range of from $-1$ to 1. For example, the throttle valve opening $\theta$ is adjusted in the range of $0 \leqq \theta \leqq 1$, the throttle valve opening $\theta$ being 1 when the throttle valve is fully open and being 0 when it is fully closed. The throttle valve opening speed $\theta$, the throttle valve opening acceleration $\theta$, and the depression time $t_e$ are adjusted such that they are expressed by the following respective equations:

$$\theta = x \times (\theta_n - \theta_{n-1})$$

$$\theta = b \times (\theta_n - \theta_{n-1})$$

$$t = 1/[1 + exp\{(150 - t_e)/5\}]$$

where a is a coefficient for dispersing the throttle valve opening speed $\theta$ in the range of $-1$ to 1, b is a coefficient for dispersing the throttle valve opening acceleration $\theta$ in the range of $-1$ to 1, and the depression time $t_e$ is the time (msec.) consumed from the beginning of depression of the accelerator pedal. The time t is adjusted, using a sigmoid function, such that the past average depression time (e.g., about 150 msec.) is represented by 0.5, and all depression times will be dispersed in the range of 0 to 1.

Figure 4:
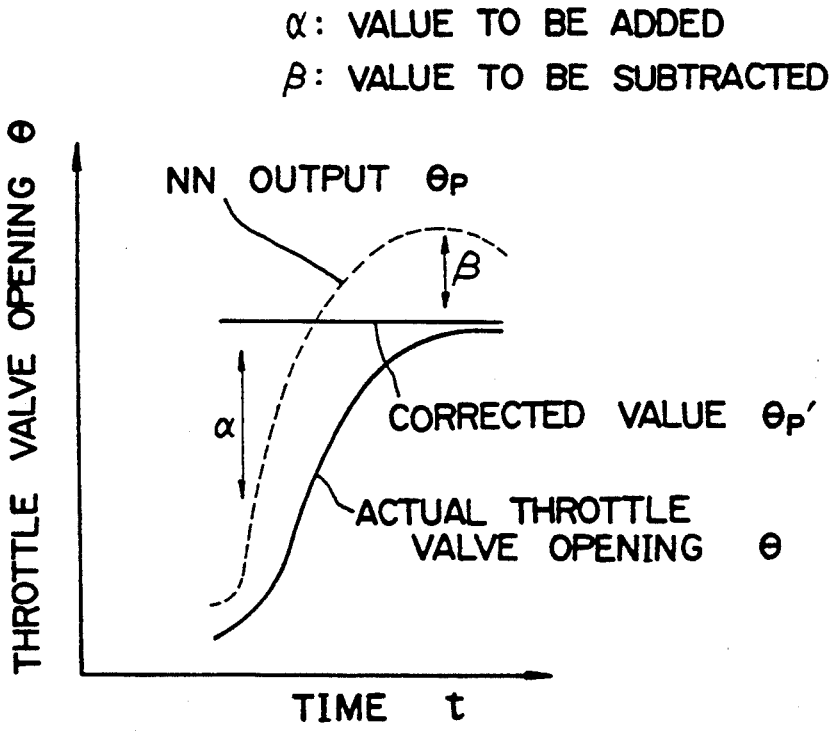
FIG. 4 is a diagram illustrative of the correction of a predicted throttle valve opening value.
Figure 5A:
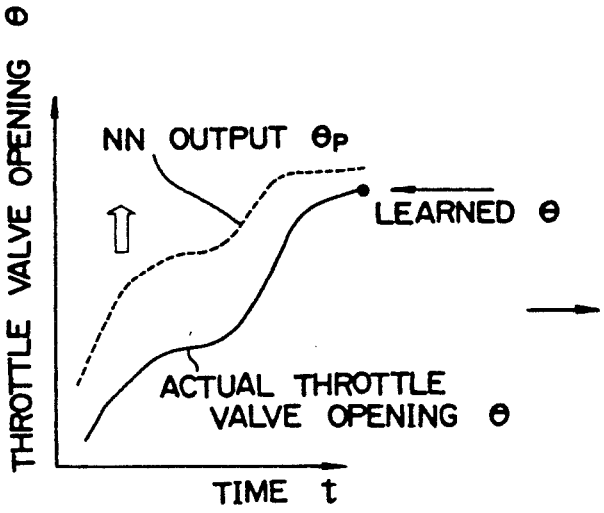
FIGS. 5(*a*) through 5(*d*) are diagrams illustrative of a learning process which is used when a throttle valve opening varies stepwise.
Figure 5B:
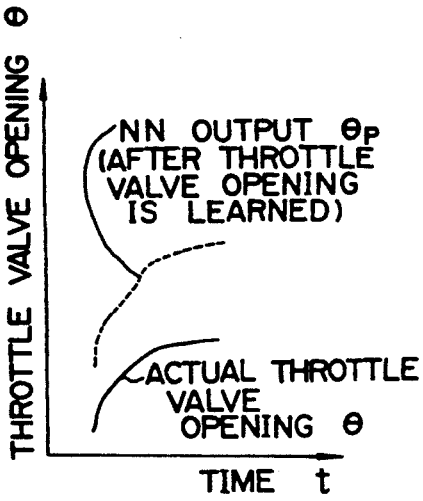
Figure 5C:
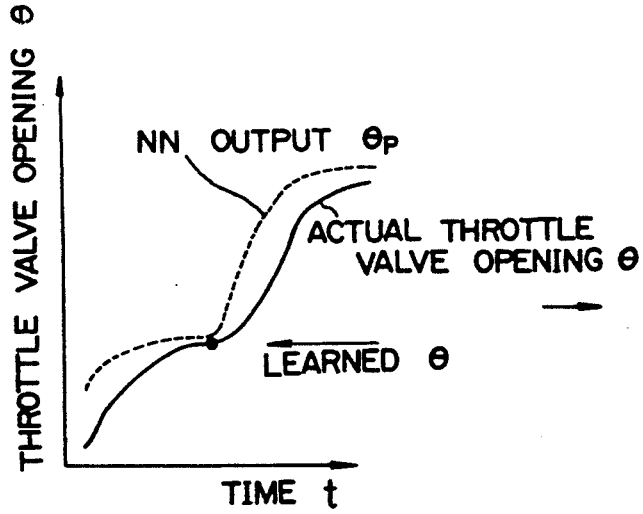
Figure 5D:
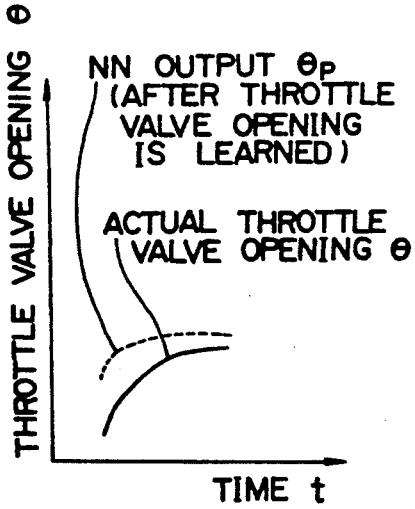
Figure 6A:
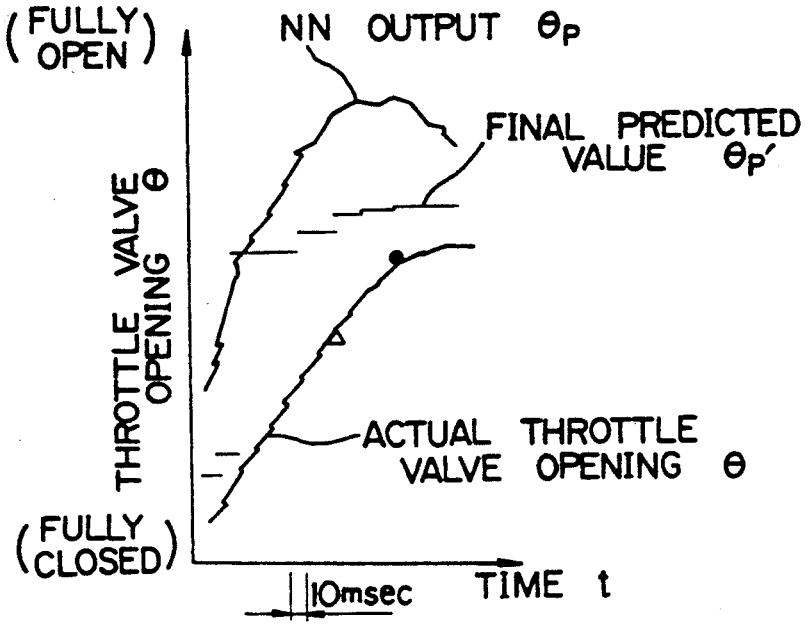
FIGS. 6(*a*) through 6(*d*)′ are diagrams showing the manner in which a final predicted throttle valve opening value varies.
Figure 6B:
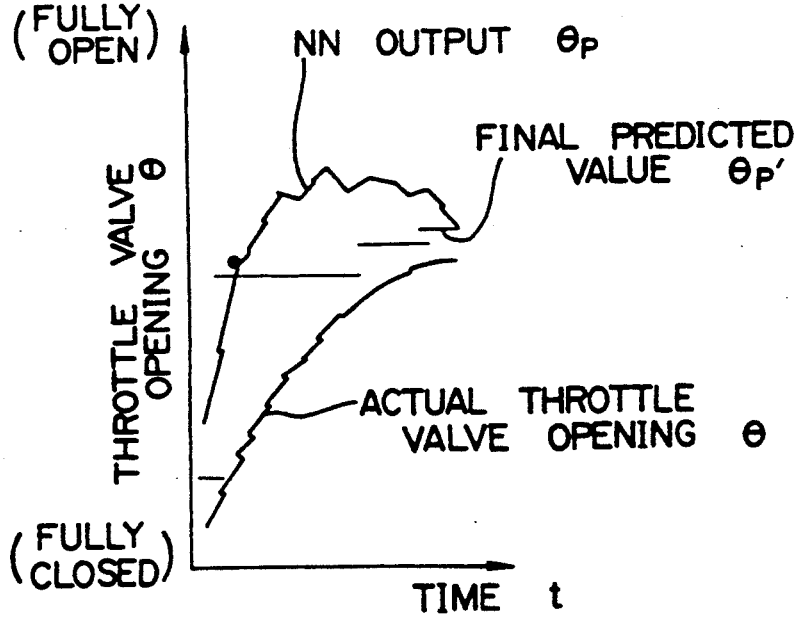
Figure 6C:
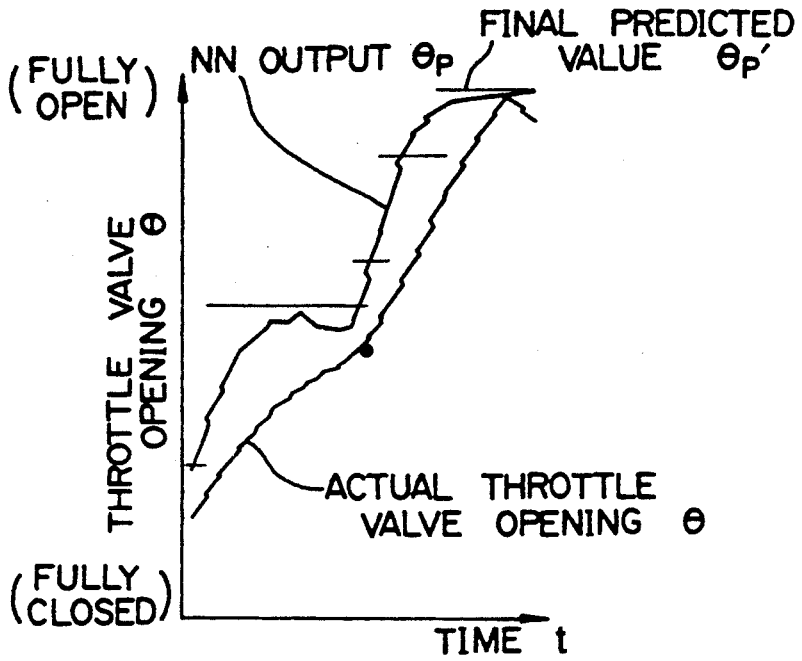
Figure 6D:
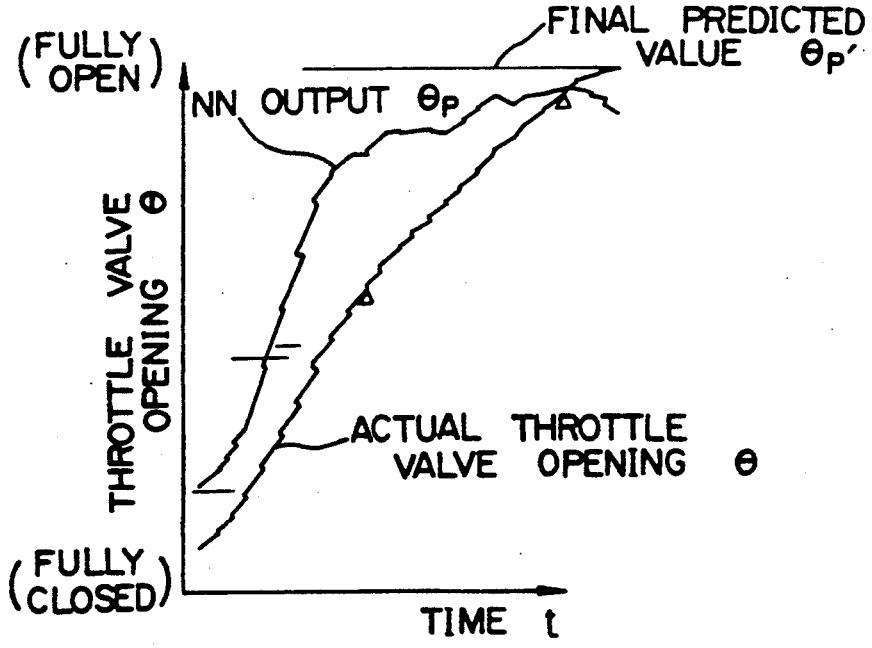

The neural network 12 produces an output signal $\theta_p$ in response to these input signals, i.e., the throttle valve opening $\theta$, the throttle valve opening speed $\theta$, the throttle valve opening acceleration $\theta$, and the depression time $t_e$. In the illustrated embodiment, as shown in FIG. 4, the output signal $\theta_p$ from the neural network 12 has a value larger than the actual throttle valve opening $\theta$. The output signal $\theta_p$ from the neural network 12 is then used for predicting a future final throttle valve opening $\theta_p'$, in the subroutine shown in FIG. 3, in a step S5.

The output signal from the neural network 12 is used in contradictory learning processes for increasing the accuracy of prediction and increasing a predicting time, as described later on, and hence is of an intermediate value which satisfies the conditions of both of the learning processes to some extent. The accuracy of prediction can be increased when the output signal $\theta_p$ from the neural network 12 is corrected by a certain increase or reduction.

According to the present invention, the output signal introduced from the neural network 12 as the final predicted throttle valve opening value $\theta_p$ is corrected as follows:

If the predicted value $\theta_p$ from the neural network 12 is excessively larger than a predetermined value $\theta_1$, the predicted value is corrected into an allowable maximum value in a step S6.

Then, the CPU 6 estimates a depression time $t_a$ until the depression by the driver of the accelerator pedal is finished, in a step S7.

After the estimation of the depression time $t_a$, the throttle valve opening speed $\theta$ and a predetermined value $\theta_1$ are compared with each other in a step S8. If the throttle valve opening speed $\theta$ is larger than the predetermined value $\theta_1$, then the CPU 6 determines that the accelerator pedal is being depressed, and compares the measured depression time $t_e$ and the past average depression completion time $t_{ave}$ with each other in a step S9, thereby determining whether the accelerator pedal is in a first or latter half period of the depression stroke. If the measured depression time $t_e$ is smaller than the average depression completion time $t_{ave}$, then, since the accelerator pedal is in the first half period of the depression stroke, the CPU 6 adds a predetermined value $\alpha$ to the predicted throttle valve opening value $\theta_p$ from the neural network 12, and regards the sum as a new final predicted throttle valve opening value $\theta_p'$ in a step S10. Conversely, if the measured depression time $t_e$ is larger than the average depression completion time $t_{ave}$, then, since the accelerator pedal is in the latter half period of the depression stroke, the CPU 6 subtracts a predetermined value $\beta$ from the predicted throttle valve opening value $\theta_p$ from the neural network 12, and regards the difference as a new final predicted throttle valve opening value $\theta_p'$ in a step S11. The predetermined values $\alpha$, $\beta$ are given as follows:

$$\alpha=\theta_n\times(1-\text{estimated time})\times(\theta_p-\theta_n)\times\gamma,$$

$$\beta=(\theta_p-\theta_n)\times\delta.$$

The estimated time falls in the range of $0\leqq$ estimated time $\leqq 1$, and is of a value close to 0 in the first half period of the depression stroke and of a value close to 1 in the latter half period of the depression stroke. $\gamma$, $\delta$ in the above equations indicate variable coefficients for adjusting the values $\alpha$, $\beta$ each time the accelerator pedal is depressed. The values $\alpha$, $\beta$ are larger than zero, i.e., $\alpha>0$, $\beta>0$.

When the predicted throttle valve opening value $\theta_p$ is corrected into the new predicted throttle valve opening value $\theta_p'$ through the addition of $\alpha$ or the subtraction of $\beta$, as described above, the predicted throttle valve opening value $\theta_p'$ is close to the actual throttle valve opening $\theta$ after the acceleration pedal depression is completed. In FIG. 4, the solid-line curve represents the manner in which the actual throttle valve opening $\theta$ varies, the chain-line curve represents the manner in which the uncorrected predicted value $\theta_p$ (i.e., the output signal from the neural network 12) varies, and the solid straight line indicates the corrected predicted value $\theta_p'$.

If the variation in the past throttle valve opening $\theta$ until it reaches a maximum value is larger is zero (i.e., each time the actual depression of the accelerator pedal is finished), then in order to increase the predicted value $\theta_p$ in the first half period of the depression stroke to increase a predicting time, the predetermined value $\alpha$, which is expressed below, should preferably be used in the step S10.

$$\alpha=\theta_n\times(1-\text{estimated time})^2\times(\theta_p-\theta_n)\times\gamma.$$

If the accelerator pedal is in the latter half period of the depression stroke in the step S9, then, instead of subtracting the predetermined value $\beta$ from the predicted value $\theta_p$ (step S11), the predicted value $\theta_p$ may be fixed rather than being updated by the periodically read output signal from the neural network 12, because the final throttle valve opening $\theta$ is generally determined at the time the first half period of the depression stroke is finished.

Thereafter, the CPU 6 compares the predicted value $\theta_p'$ and a predetermined value $\theta_1'$ in a step S12. If the predicted value $\theta_p'$ is smaller than the predicted value $\theta_1'$, and hence is too small as a predicted value, then the CPU 6 adds a value $f(\theta)$ proportional to the throttle valve opening speed $\theta$ to the predicted value $\theta_p'$, and uses the sum as a new predicted value $\theta_p''$ in a step S13. This is because the final throttle valve opening $\theta$ is generally proportional substantially to the throttle valve opening speed $\theta$.

Then, the CPU 6 compares the throttle valve opening speed $\theta$ and a predetermined value $\theta_2$ with each other in a step S14. If the throttle valve opening speed $\theta$ is larger than the predetermined value $\theta_2$, and hence the throttle valve is being opened at a considerably high speed, then the CPU 6 presumes that the throttle valve will be fully opened, and sets the predicted throttle valve opening value $\theta_p'$ or $\theta_p''$ to 1 in a step S15. Thereafter, if the predicted value $\theta_p'$ or $\theta_p''$ is an excessive value, then it is corrected into an allowable maximum value in a step S16.

The predicted value $\theta_p''$ or $\theta_p''$, which has been corrected as required, is used as control data for controlling the automatic transmission 10 and the fuel injection unit 11, and the CPU 6 produces control commands based on the control data, in a step S17.

When the automatic transmission 10 and the fuel injection unit 11 are controlled on the basis of the predicted value $\theta_p'$ or $\theta_p''$, the automatic transmission 10 can effect a quick downshift while suppressing the shift shock and reducing the time lag before the downshift is completed, and the fuel infection unit 11 allows the engine to be controlled with a good response. When the throttle valve opening speed $\theta$ subsequently becomes 0, the CPU 6 controls the neural network 12 to learn the data, using a back propagation thereof, so that the output signal $\theta_p$ of the neural network 12 approaches the actual throttle valve opening $\theta$ at that time, in steps S18 and S19.

The neural network 12 is controlled to learn the data each time one series of throttle valve opening changes or variations is finished while the motor vehicle is running. The neural network 12 is then capable of predicting how far the throttle valve will be opened, at the time the throttle valve starts being opened, taking into account habitual actions of the driver and other factors, with the result that the predicted value has an increased degree of accuracy.

The learning process is carried out by varying the weighting of the output signals from the neurons of the neural network 12. It is preferable that limitations be placed on the amount by which the learned data can be corrected, thus preventing the accuracy of prediction from being lowered by abnormal accelerator pedal depressions and noise.

Generally, if the learning process is effected with greater importance on the accuracy of prediction, then the predicting time is increased. If the learning process is effected for quicker prediction, then the accuracy of prediction is lowered. To avoid this problem, different learning methods are selectively employed in carrying out the learning process.

For example, if the accuracy with which the throttle valve opening $\theta$ is predicted does not fall within an error of 20%, then the throttle valve opening is learned in a manner to reduce the extent of prediction when the throttle valve opening has been excessively predicted or to increase the extent of prediction when the throttle valve opening has been insufficiently predicted. In the event that the final predicted throttle valve opening value is not met, the number of downshifts which are effected is somewhat increased. However, since the advantages of reduced shift shocks and time lags are considered to be greater than the disadvantage of the increased downshifts, the predicting time may be increased even if a predicting error of about 10% is allowed.

It is assumed that the actual throttle valve opening $\theta$ varies in a step-like pattern having a sagging area as shown in FIG. 5(*a*). If the throttle valve opening $\theta$ is learned at the time the throttle valve opening speed $\theta$ is zero (i.e., each time the actual depression of the accelerator pedal is finished), then the accuracy of prediction will be lowered when the throttle valve opening $\theta$ does not vary in a step-like pattern as shown in FIG. 5(*b*). If the throttle valve opening $\theta$ is learned each time an inflection point is reached (i.e., each time the throttle valve opening speed $\theta$ is minimized and the depression of the accelerator pedal is temporarily stopped) as shown in FIG. 5(*c*), then the prediction accuracy is increased as shown in FIG. 5(*d*).

When the actual throttle valve opening $\theta$ is near a fully opened or closed position, a throttle valve opening value near 0 or 1 is learned. If such a value is repeatedly learned, the learned data become influential enough to destroy the synapse load that has been formed so far. Since the throttle valve opening near a fully opened position is actually not learned, only the learning of a throttle valve opening value near a fully closed position poses a problem. One solution would be to limit the throttle valve opening $\theta$ which is to be learned by the neural network 12 to the range of $0 \leqq \theta \leqq 0.9$, or to have the neural network 12 learn throttle valve opening values except a fully opened position in the first half period of the depression stroke.

In the correction of the predicted throttle valve opening value $\theta_p'$ if the output signal produced as the predicted throttle valve opening value $\theta_p$ from the neural network 12 abruptly changes, i.e., if the difference between the preceding neural network output signal and the present neural network output signal is large, then the synapse load may be corrected in order to reduce the change in the output signal, i.e., the difference between the preceding and present output signals.

The predicted throttle valve opening value $\theta_p'$ which is finally obtained, the actual throttle valve opening $\theta$, and the output signal $\theta_p$ from the neural network 12, as they vary under different conditions, are illustrated in FIGS. 6(*a*) through 6(*d*).

FIG. 6(*a*) shows a final predicted value $\theta_p'$ obtained when the actual throttle valve opening $\theta$ is learned each time the throttle valve opening speed $\theta$ becomes zero (i.e., each time the actual depression of the accelerator pedal is finished).

FIG. 6(*b*) shows a final predicted value $\theta_p'$ obtained when the actual throttle valve opening $\theta$ is learned at the time the throttle valve opening speed $\theta$ is maximized.

FIG. 6(*c*) shows a final predicted value $\theta_p'$ obtained when the actual throttle valve opening $\theta$, as it varies in a step-like pattern, is learned at the time the throttle valve opening speed $\theta$ is minimized (i.e., at the time the depression of the accelerator pedal is temporarily stopped).

FIG. 6(*d*) shows a final predicted value $\theta_p'$ obtained when the throttle valve opening speed $\theta$ is large and a fully opened throttle valve position is predicted.

In FIGS. 6(*a*) through 6(*d*), the symbol • indicates the position where the throttle valve opening is learned, and the symbol Δ indicates the position where the automatic transmission effects a kickdown.

With the motor vehicle control method according to the present invention, as described above, the neural network is controlled to learn throttle valve opening data each time a series of throttle valve opening changes is finished while the motor vehicle is running. The neural network with the learned data is capable of predicting, with high accuracy, how far the throttle valve will be opened, taking into account habitual actions of the driver, at the time the throttle valve starts being opened. Based on the output signal from the neural network, the operating condition of the motor vehicle can be controlled.

Furthermore, when the rate of change of the actual throttle valve opening is minimized before the rate of change becomes zero, the neural network learns the actual throttle valve opening at that time so that the predicted throttle valve opening value approaches the learned actual throttle valve opening. Accordingly, the throttle valve opening can be predicted with high accuracy.

The predicted throttle valve opening value is corrected to prevent it from becoming an undesirable value. The correcting process also allows the throttle valve opening to be predicted with high accuracy.

Although a certain preferred embodiment has been shown and described, it should be understood that many changes and modifications may be made therein without departing from the scope of the appended claims.

What is claimed is:

1. A method of controlling a motor vehicle having an engine, with a neural network which has a learning capability, comprising the steps of:

periodically supplying a present value of the throttle valve opening of the engine and a rate of change of the present value of the throttle valve opening to the neural network;

controlling the neural network to learn the present value of the throttle valve opening when the rate of change of the present value of the throttle valve opening becomes zero so that a predicted value of the throttle valve opening approaches the actual value of the throttle valve opening at the time the rate of change thereof becomes zero; and controlling an operating condition of the motor vehicle based on the predicted value of the throttle valve opening, which is represented by a periodically produced output signal from said neural network.

2. A method according to claim 1, wherein said step of controlling the neural network comprises the step of controlling the neural network to learn the present value of the throttle valve opening when the rate of change thereof is minimized before the rate of change becomes zero so that a predicted value of the throttle valve opening approaches the actual value of the throttle valve opening at the time said rate of change is minimized.

3. A method according to claim 1 or 2, further comprising the steps of correcting the predicted value of the throttle valve opening and controlling the operating condition of the motor vehicle based on the corrected predicted value of the throttle valve opening.

4. A method according to claim 3, wherein said step of correcting the predicted value comprises the steps of increasing the predicted value of the throttle valve opening if said present value and said rate of change thereof supplied to the neural network are in a first half period of the stroke of the throttle valve opening, and reducing the predicted value of the throttle valve opening if said present value and said rate of change supplied to the neural network are in a latter half period of the stroke of the throttle valve opening.

5. A method according to claim 4, further including the steps of determining said present value and said rate of change thereof to be in the first half period of the stroke of the throttle valve opening if the period of time from the starting time when the throttle valve opening starts to vary to the completion time when the present value of the throttle valve opening is reached is shorter than the past average period of time from the starting time to the completion time, and determining said present value and said rate of change thereof to be in the latter half period of the stroke of the throttle valve opening if the period of time from the starting time when the throttle valve opening starts to vary to the completion time when the present value of the throttle valve opening is reached is longer than the past average period of time from the starting time to the completion time.

6. A method according to claim 3, wherein said step of correcting the predicted value comprises the step of canceling updating the periodically produced output signal from said neural network if said present value and said rate of change supplied to the neural network are in a latter half period of the stroke of the throttle valve opening.

7. A method according to claim 6, further including the steps of determining said present value and said rate of change thereof to be in the first half period of the stroke of the throttle valve opening if the period of time from the starting time when the throttle valve opening starts to vary to the completion time when the present value of the throttle valve opening is reached is shorter than the past average period of time from the starting time to the completion time, and determining said present value and said rate of change thereof to be in the latter half period of the stroke of the throttle valve opening if the period of time from the starting time when the throttle valve opening starts to vary to the completion time when the present value of the throttle valve opening is reached is longer than the past average period of time from the starting time to the completion time.

8. A method according to claim 3, wherein said step of correcting the predicted value comprises the step of adding a value proportional to said rate of change to the predicted value of the throttle valve opening if the output signal from said neural network is smaller than a predetermined value.

9. A method according to claim 3, wherein said step of correcting the predicted value comprises the step of equalizing said predicted value to a fully opened value of the throttle valve opening if said rate of change of the present value of the throttle valve opening is greater than a predetermined value.

10. A method according to claim 3, wherein said step of correcting the predicted value comprises the step of reducing an abrupt change in the periodically produced output signal from said neural network.

* * * * *